United States Patent [19]

Fleming

[11] Patent Number: 4,886,183

[45] Date of Patent: Dec. 12, 1989

[54] BEVERAGE CONTAINER HOLDER

[76] Inventor: Keith A. Fleming, Star Rte. 31, Ellsworth, Me. 04633

[21] Appl. No.: 178,990

[22] Filed: Apr. 7, 1988

[51] Int. Cl.[4] ..... F21K 2/00

[52] U.S. Cl. ..... 220/85 H; 362/101; 362/155; 220/902

[58] Field of Search ..... 220/85 H, 3.1, 902; 62/530; 40/306, 310; 362/155, 154, 101, 253, 251

[56] References Cited

U.S. PATENT DOCUMENTS

| | | | |
|---|---|---|---|
| 2,644,882 | 7/1953 | Voda | 362/155 X |
| 3,351,347 | 11/1967 | Smith et al. | 362/253 X |
| 4,034,213 | 7/1977 | Norris | 362/101 X |
| 4,344,303 | 8/1982 | Kelly, Jr. | 220/902 X |
| 4,563,726 | 1/1986 | Newcomb et al. | 362/101 X |
| 4,754,379 | 6/1988 | Kelley | 362/154 X |

*Primary Examiner*—Steven M. Pollard

*Attorney, Agent, or Firm*—David F. Gould

[57] ABSTRACT

A holder for canned or bottled beverages which thermally insulates the beverage and provides a message display in lamps visible on the outer surface of the holder at the election of the user of the holder.

3 Claims, 1 Drawing Sheet

BEVERAGE CONTAINER HOLDER

BACKGROUND

1. Field of the Invention

My invention relates to holders for cold beverages and more particularly relates to a holder which can flash a lighted message. The principle of the invention is a plurality of lamps mounted in a thermally insulating jacket that wraps around the beverage container. It finds its use in dimly lit rooms where people are entertaining.

2. The Prior Art

The prior art includes: an advertising message that is wrapped around a beverage can; glass holders which are illuminated from below; and illumination inserts which are placed in the beverage itself.

SUMMARY OF THE INVENTION

My invention is a solution to the problem of how to illuminate a message in lights that may be seen on the surface of a thermally insulating beverage can holder. A message or slogan is spelled out in small lamps which are mounted close to the outer surface of the beverage container holder. The lamps are connected to a battery by means of wires running through the thermal insulation of the beverage container holder. A switch is provided between the battery and the lamps to control the illumination of the lamps at the option of the user of the holder.

DESCRIPTION OF PREFERRED EMBODIMENT

Figure 1:
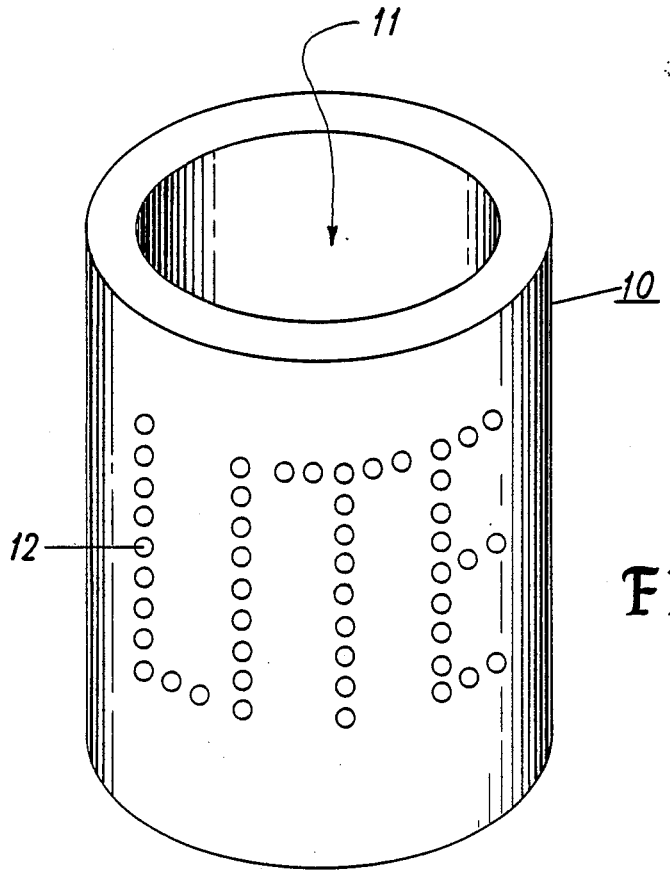
FIG. 1 is a perspective view of my invention.
Figure 2:
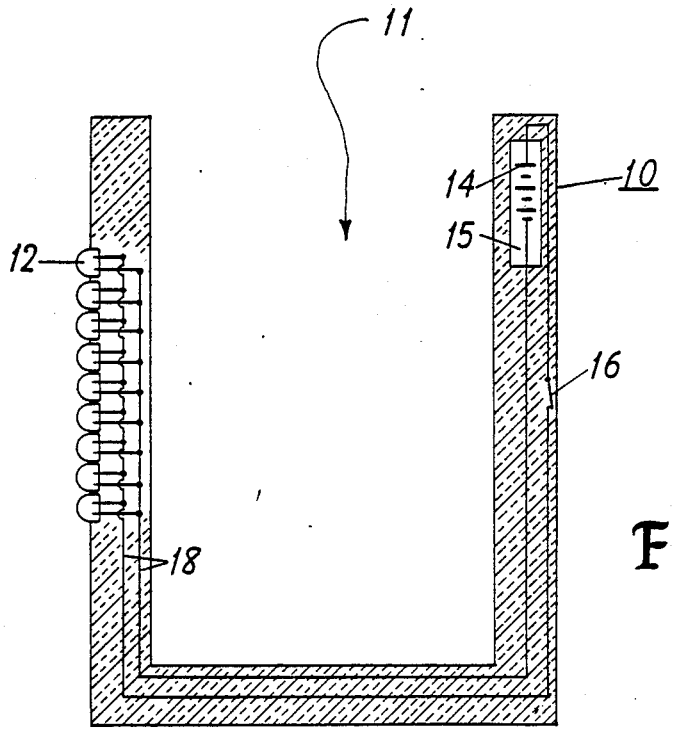
FIG. 2 is a sectional view of a side elevation of my invention.

As shown in the drawings, where like numerals refer to like parts throughout, a relatively thick hollow cylinder of foam thermal insulation 10 is provide. The inside bore 11 of the insulation cylinder 10 is sized to receive a beverage can of the usual 12 oz. or 16 oz. size. A group of small lamps such as lamp 12 are provided to spell out a name, message or slogan. The lamps preferably are light emitting diodes (LED) because of their long life and low current draw. For instance here, the lamps spell a message 13 which in this case is the word "LITE". A battery 14 is provided in a battery compartment 15 which is carved out of the thermally insulating foam 10. The battery compartment 15 is shown here located at the top of the holder so as to enable easy access to change batteries. Wires 18 are provided to connect the battery 14 to the lamps such as lamp 12 through thumb switch 16. The switch 16 is located near the outer surface of the holder where it is easily accessible to the user. The lamps may be pre-mounted on a circuit board spelling out a message and then cast into the foam insulation during its manufacture.

OPERATION

In operation, a beverage can (not shown) is placed in the bore 11 of the holder. The foam insulation 10 of the holder insulates the user's hand from the cold beverage can. When the user desires to illuminate the message 13, he closes the switch 16. This connects the battery 14 to the lamps such lamp 12. The lamps such as lamps 12 are preferably connected in parallel so as to display at least a partial message should one or more of the lamps fail to light. Although one battery 14 is shown, it will be understood that more than one battery can be used depending on the voltage and current requirements of the lamps. The battery 12 may be a 9 volt battery provided an appropriate resistor is used according to the number of lamp 16 that are used. The battery 14 may optionally be mounted on the exterior of the holder to aid in the changing the battery 14. When the message is no longer desired to be illuminated, the switch 16 can be opened thus preventing a drain on the battery 14. The switch 16 may be of the squeeze type so that the switch 16 is closed only when the user is squeezing the resilient foam 10 of the holder as when drinking from it. My invention is a novel advertising or entertainment device for use with beverage containers. The foregoing is considered as illustrative only of the principles of the invention. Furthermore, since numerous modifications and changes will readily occur to those skilled in the art, it is not desired to limit the invention to the exact construction and operation shown and described, and accordingly all suitable modifications and equivalents may be resorted to falling with the scope of the invention as claimed.

I claim:

1. In a selectively illuminated beverage container holder, the combination comprising;

a. a thermally insulated jacket for a beverage container, b. a plurality of lamps disposed in the insulated jacket, c. a source of electrical power to light the lamps, d. a pressure switch to connect the lamps to the source of electrical power.

2. The selectively illuminated beverage container holder of claim 1 in which the lamps are light emitting diodes.

3. The selectively illuminated beverage container holder of claim 1 in which the source of electrical power is a battery.

* * * * *